US008071870B1

(12) United States Patent
Bailey et al.

(10) Patent No.: US 8,071,870 B1
(45) Date of Patent: Dec. 6, 2011

(54) LIGHT BEAM SHAPING IN AN OPTICAL PICK UP FOR A MUSICAL INSTRUMENT

(76) Inventors: James S. Bailey, Anaheim Hills, CA (US); Kenneth R. Bailey, Pueblo, CO (US)

( * ) Notice: Subject to any disclaimer, the term of this patent is extended or adjusted under 35 U.S.C. 154(b) by 0 days.

(21) Appl. No.: 12/687,413

(22) Filed: Jan. 14, 2010

(51) Int. Cl.
*G10H 3/06* (2006.01)

(52) U.S. Cl. ..... 84/724

(58) Field of Classification Search ..... 84/724
See application file for complete search history.

(56) References Cited

U.S. PATENT DOCUMENTS

| | | | | |
|---|---|---|---|---|
| 3,472,943 | A | 10/1969 | Kawabata et al. | |
| 4,061,934 | A | 12/1977 | Rowe | |
| 4,147,084 | A | 4/1979 | Underwood | |
| 4,688,460 | A * | 8/1987 | McCoy | 84/724 |
| 4,730,530 | A * | 3/1988 | Bonanno | 84/724 |
| 4,736,662 | A * | 4/1988 | Yamamoto | 84/724 |
| 4,815,353 | A * | 3/1989 | Christian | 84/724 |
| 5,012,086 | A * | 4/1991 | Barnard | 250/222.1 |
| 5,189,241 | A | 2/1993 | Nakamura | |
| 5,237,126 | A * | 8/1993 | Curtis et al. | 84/724 |
| 5,539,147 | A | 7/1996 | Hoshino | |
| 5,945,622 | A | 8/1999 | Yamada | |
| 6,198,036 | B1 | 3/2001 | Hoshino | |
| 2006/0207413 | A1 * | 9/2006 | Tisserand | 84/724 |
| 2010/0011942 | A1 * | 1/2010 | Wessels | 84/724 |

FOREIGN PATENT DOCUMENTS

| | | |
|---|---|---|
| CA | 2053118 | 4/1992 |
| KR | 9407134 B1 | 8/1994 |

* cited by examiner

*Primary Examiner* — Jeffrey Donels
(74) *Attorney, Agent, or Firm* — Patent Law & Venture Group; Gene Scott

(57) ABSTRACT

An optical pickup transducer senses vibrations of string instruments transducing the vibrations into an electrical signal with fidelity, high signal-to-noise ratio and with exclusion of extraneous effects such as noise. The transducer includes a housing with an upper deck that holds one or more light emitters, and a lower deck that holds light sensors in a one-to-one arrangement with the emitters so that each sensor is physically in opposition to each emitter. For application to the string instruments, each string is conducted through the light beam between an emitter and a sensor. The sensors may be photodiodes, so that their electrical output is related to the amount of incident light and therefore varies with the movement of the string, that is, the string modulates the incident light on the photodiode. This electrical output is then amplified to drive a loudspeaker.

18 Claims, 4 Drawing Sheets

LIGHT BEAM SHAPING IN AN OPTICAL PICK UP FOR A MUSICAL INSTRUMENT

BACKGROUND OF THE INVENTION

1. Field of the Present Disclosure

This disclosure relates generally to vibration pickups for stringed instruments and particularly to an optical pickup with transduction circuit for stringed instruments.

2. Description of Related Art Including Information Disclosed Under 37 CFR 1.97 and 1.98

Kawabata et al U.S. Pat. No. 3,472,943 discloses a circuit using two coils as pickup elements influenced by string vibrations. The circuit simulates movement of the pickup elements for changing tone. Rowe U.S. Pat. No. 4,061,934 discloses a pickup using a piezoelectric element in contact with the strings of the instrument. Underwood U.S. Pat. No. 4,147,084 discloses a bridge with an integral transducer element. Melvin CA 2053118 discloses an electromagnetic pickup for an instrument with steel strings or strings with a metallic coating. Nakamura U.S. Pat. No. 5,189,241 discloses a pickup having a differential amplifier for eliminating noise. Hoshino U.S. Pat. No. 5,539,147 discloses a guitar pickup structure which includes pickup elements located below the guitar string's saddle to pickup vibrations of the saddle. Yamada U.S. Pat. No. 5,945,622 discloses a piezoelectric pickup inserted between the bridge and the body of the instrument. Hoshino U.S. Pat. No. 6,198,036 discloses an electric guitar tremolo bridge which holds the instrument's strings in contact with a piezoelectric pickup.

The related art described above discloses electric induction, electromagnetic and piezoelectric transducer pickups for musical instruments, e.g., stringed instruments. However, the prior art fails to disclose optical transducer methods. The present disclosure distinguishes over the prior art providing heretofore unknown novel and non-obvious optical transduction approaches with advantages as described in the following summary.

BRIEF SUMMARY OF THE INVENTION

This disclosure teaches certain benefits in construction and use which give rise to the objectives described below.

The present invention is an optical pickup transducer for a stringed instrument and is potentially useful in sensing vibrations in other instruments including wind, percussion and drums. Wherever the transducer is able to be nested with a vibrating portion of an instrument, or with a pickup flap attached to a vibrating portion, the optical pickup is able to transduce the vibrations into an electrical signal with fidelity, high signal-to-noise ratio and with exclusion of extraneous effects such as noise. The transducer is comprised of a housing with an upper deck that holds one or more light emitters, and a lower deck that holds light sensors in a one-to-one arrangement with the emitters so that each sensor is physically in opposition to one emitter. For application to the string instruments, each string is conducted through the light beam between an emitter and a sensor. The sensors may be photodiodes, so that their electrical output is related to the amount of light that falls on them and therefore varies with the movement of the string, that is, the string modulates the incident light on the photodiode. This electrical output is then amplified to drive a loudspeaker.

An objective of the present invention is to pick up musical string vibrations faithfully.

A further objective of the present invention is to pick up such string vibrations while ignoring extraneous effects such as noise and without dampening the strings.

A further objective of the present invention is to pick up such string vibrations as an optical signal while converting it to a composite electrical signal available for being amplified and dispersed as an audio output, as, for instance, through a loudspeaker.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWINGS)

Illustrated in the accompanying drawing(s) is at least one of the best mode embodiments of the present invention In such drawing(s).

DETAILED DESCRIPTION OF THE INVENTION

The above described drawing figures illustrate the described apparatus and its method of use in at least one of its preferred, best mode embodiments, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present invention.

As summarized above, the present invention is an optical pickup transducer and operating circuit, primarily useful for a stringed instrument such as a guitar or ukulele and is potentially useful in sensing vibrations in other instruments including wind, percussion and drums. Wherever the transducer is able to be nested with a vibrating portion of an instrument, or with a pickup element attached to a vibrating portion, the optical pickup is able to transduce the vibrations of the instrument into an electrical signal with fidelity, high signal-to-noise ratio and with exclusion from the pickup of extraneous noise effects such as from electrical, electromagnetic, magnetic, electrical induction and sound sources.

Figure 1:
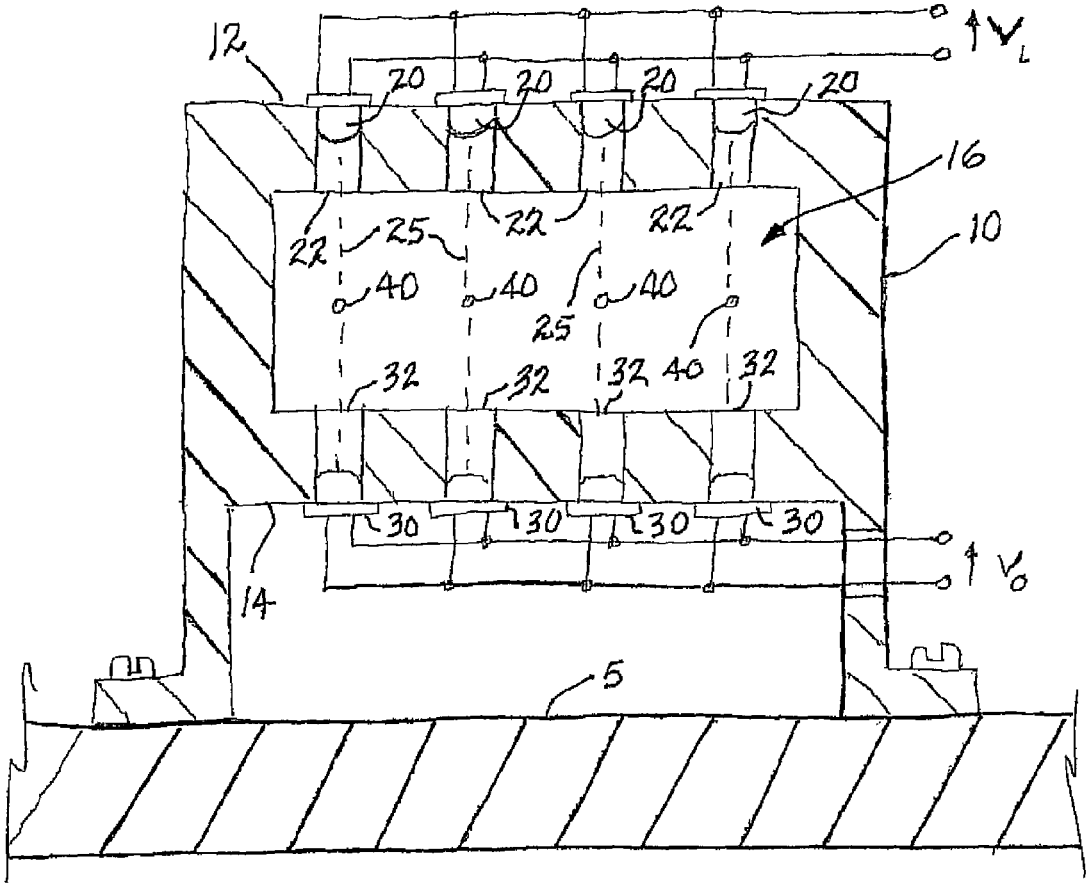
FIG. 1 is a vertical cross-sectional view of the invention described herein as viewed along the strings of a musical stringed instrument and with top mounted emitters.

In its preferred enablement, the invention is comprised of a housing 10 with an upper deck 12 that holds one or more light emitters (emitters) 20, and a lower deck 14 that holds receivers 30. The upper and lower decks 12, 14 are arranged in spaced apart parallel positions as shown in FIG. 1. Also shown in FIG. 1 are the strings 40 of a musical instrument which extend through the space 16 between the decks 12, 14. The emitters 20 are mounted in emitter holes 22 which extend through the upper deck 12 and are typically in parallel and spaced apart from each other. The receivers 30 are mounted in receiver holes 32 which extend into the lower deck 14 and are typically in parallel and spaced apart from each other. Each pair of emitter holes 22 and receiver holes 32 are co-axial, that is, they are on a mutual center line 25 which is also the center of the emitted light beam so that light beam emitted from each emitter 20 falls directly onto its respective receiver 30. In passing from emitter 20 to receiver 30 each light beam passes one of the strings 40 of the musical instrument 5 upon which the invention is securely mounted. As the strings 40 vibrate they modulate the amount of light that falls on the receivers 30.

Figure 2:
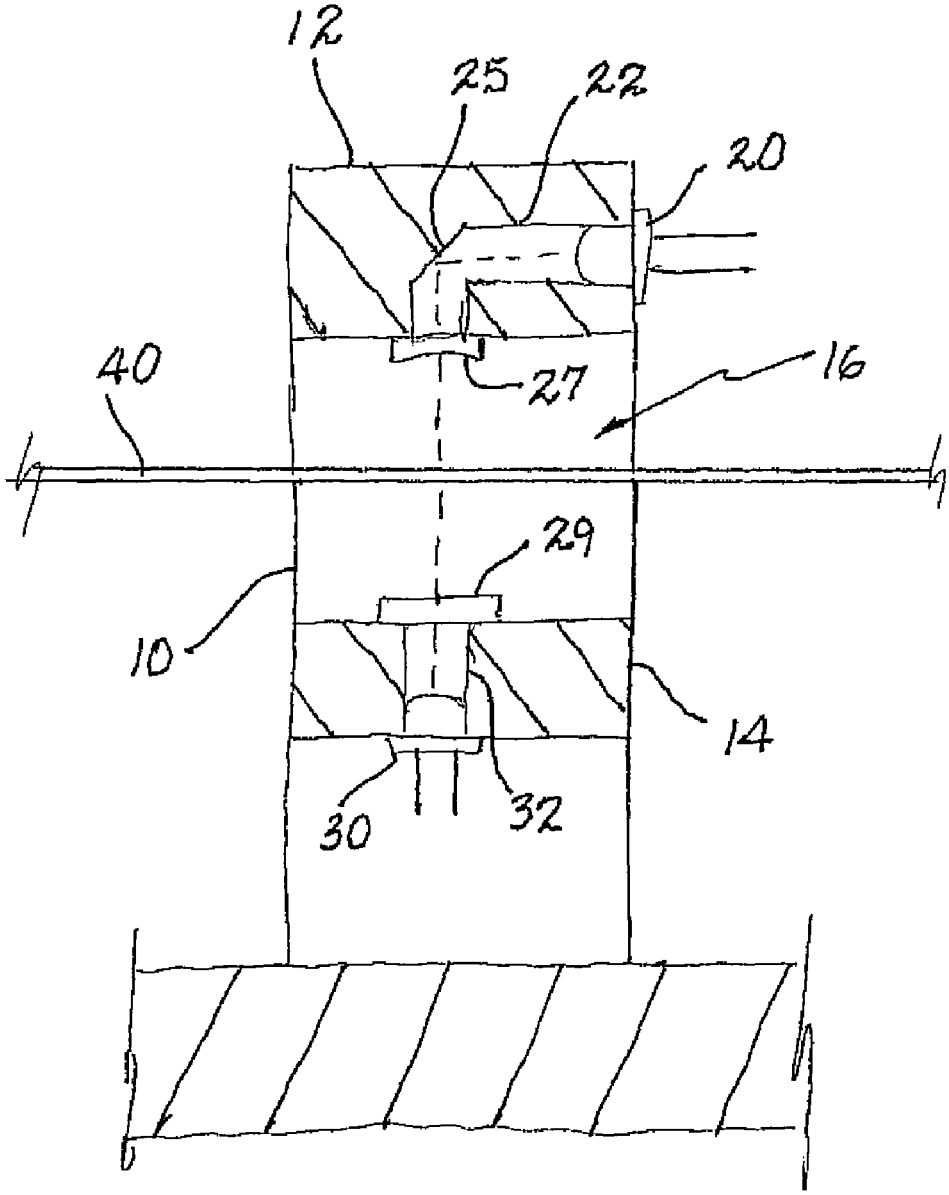
FIG. 2 is a side elevational cross-sectional view thereof with side mounted emitters and a dogleg emitter channel.

Emitters 20 are typically mounted in a package wherein the light beam is emitted along a path that is collinear with its leads or pigtails as indicated in FIG. 1. On a typical stringed instrument this may produce an awkward arrangement with the leads extending away from the face of the instrument and thereby presenting a high profile. To solve this problem, the arrangement of FIG. 2 may be employed. Here, the emitter holes 22 are oriented in parallel with the strings 40. The emitter holes 22 are dog-legged at a right angle as shown in FIG. 2, with the hole junction 25 set at a 45° angle. The hole junction 25 has a mirrored surface that reflects emitted light to the receiver 30. In this arrangement, therefore, the total height of the assembly can be maintained as low as possible since the electrical connections to the emitters 20 are routed to one side of the housing 10 rather than to its top. A collimating lens 27 may be fixed at the outlet of emitter hole 22 so that the light emitted across space 16 is uniform, homogenous and in a desired shape as will be described below. Also, in FIG. 2 an aperture plate 29 is shown at the entrance to receiver hole 32. This plate 29 may have a triangular opening, preferably equilateral, so that the light beam passing to receiver 30 also has such a form in cross-section. Alternately, the plate 29 may be placed at the outlet of the emitter hole 22 (not shown).

Figure 3:
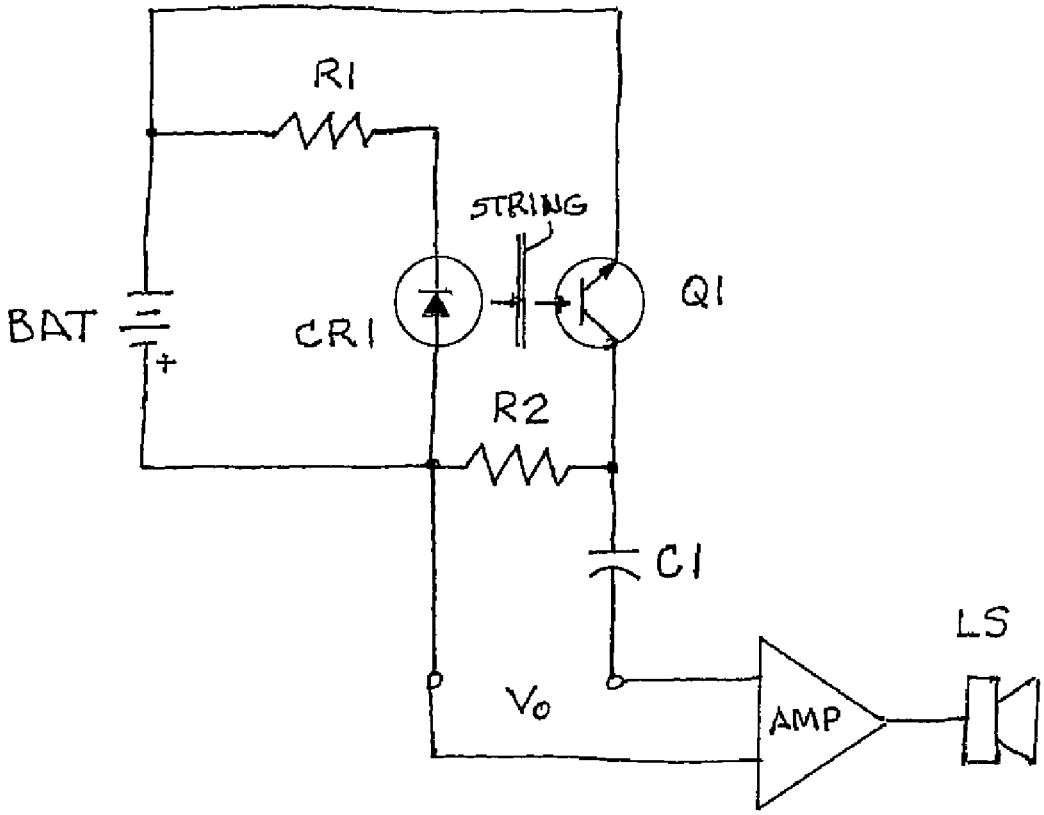
FIG. 3 is an electrical schematic diagram of a single stage of the invention whereby multiple stages may be ganged in parallel electrical interconnection.

The emitters 20 are preferably light emitting diodes (LEDs) and the receivers 30 are preferably phototransistors. The components used in the circuit shown in FIG. 3 are a matched pair of infrared LED emitter and infrared phototransistor detector; both axially leaded devices available from Radio Shack as model 276-142 which is also the RS catalog number. The phototransistor may alternately be a Texas Instruments #TIL99 which is mounted in a TO-18 package. In this circuit, emitter CR1 is forward biased by R1 and receiver Q1 is biased by R2. Output voltage Vo is modulated according to the frequency of vibration of the string 40 of the instrument. Therefore, the output voltage Vo forms a cyclic waveform which may resemble a saw-tooth wave FIG. 4B, or, as will be shown, it may resemble a modified sinusoid, FIG. 5B.

Figure 4A:
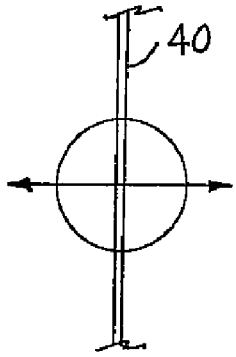
FIG. 4A is an illustration showing a circular light beam outline and a string of the musical instrument superimposed in a rest position.
Figure 5:
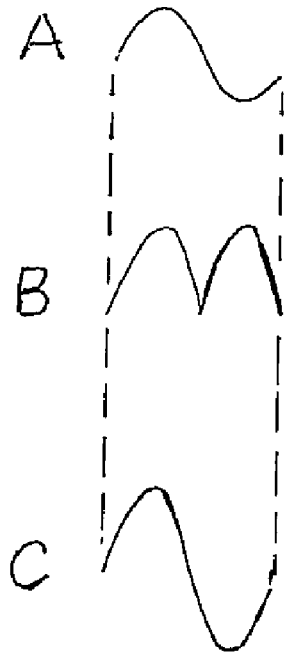
FIG. 5 is a diagram showing the waveform at A, of a musical instrument string as a single cycle of its vibration; and at B, a corresponding one cycle waveform of the light incident on a light detector of the invention when the light beam is circular; and at C, a corresponding one cycle waveform of the light incident on the light detector of the invention when the light beam is triangular.

In a first approach to detection in the present invention the receiver 30 has an incidence plate whose normal is coincident to the axis of the light beam, and this plate is homogeneously sensitive to light energy over its entire area of incidence. The incident light beam produced by the emitter 20 has a circular cross-section as shown in FIG. 4A. The arrow in this figure shows the direction of string vibration as it moves across the light beam. The rest position of string 40 is as shown in FIG. 4A, i.e., approximately bisecting the light beam. During the maximum excursion of string 40, meaning its maximum side to side movement as it vibrates, it moves between the left and right edges of the light beam passing through its rest position twice. At rest, string 40 occludes a maximum amount of the light beam and at its left-most and right-most positions it occludes a minimum amount of the light beam. Therefore, during a single vibration cycle of string 40 receiver 30 receives two maximums and two minimums of incident light as shown in waveform B in FIG. 5. Waveform A in FIG. 5 is the sinusoidal wave of one cycle of the string 40. In this approach, the tone produced has a frequency that is double the frequency of string 40 which is undesirable.

Figure 4B:
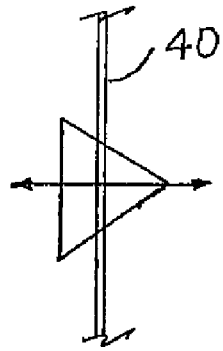
FIG. 4*b* is an illustration showing a triangular light beam outline and a string of the musical instrument superimposed in a rest position.

In a second approach of the present invention, the receiver 30 is identical to that of the first approach. Now, in contrast to the above, the incident light beam has the cross-section of an equilateral triangle as shown in FIG. 4B due to the use of the aperture plate 29. As above, the arrow in this figure shows the direction of string vibration. The rest position of string 40 is as shown in FIG. 4B, i.e., approximately bisecting an altitude of the triangle. The altitude of the triangle is approximately equal to the maximum total excursion of string 40 so that string 40 moves between an apex and a base of the triangle as shown in FIG. 4B. At rest, string 40 occludes less than a maximum amount of the light beam. When the string 40 is at the apex a maximum amount of light falls incident onto receiver 30, and when the string 40 is at the base of the triangle, a least amount of light is incident on receiver 30. Therefore, during a single vibration cycle of string 40 it swings from its rest position, to the triangle's apex, back through the rest position, then to the triangle's base and back to the rest position. The voltage output from receiver 30 during this cycle goes through a single maximum and a single minimum as shown in FIG. 5 at waveform C. Therefore, the output voltage Vo closely mimics the cycle of string 40 producing a musical tone associated with the actual frequency of vibration of string 40.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An optical pickup for a musical instrument, a string thereof arranged adjacent to a face surface of the musical instrument, the optical pickup comprising:

a housing having an upper deck spaced apart from a lower deck;

a light emitter mounted in the upper deck and enabled for producing and directing a light beam through a transmission channel toward the string of the musical instrument wherein the transmission channel includes a right angle mirrored transition surface whereby the light beam emitted into the transmission channel is turned by 90° before exiting the transmission channel;

a light receiver mounted in the lower deck, and positioned for receiving the light beam emitted by the light emitter and occluded by the string of the musical instrument;

an electrical circuit including the light emitter and the light receiver, the electrical circuit enabled for energizing the light emitter for producing the light beam and for converting light energy of the light beam incident on the light receiver to an electrical voltage, the electrical circuit further providing a driver for driving an audio output device.

2. The optical pickup of claim 1 wherein the light emitter is a light emitting diode and the light receiver is a phototransistor.

3. The optical pickup of claim 1 wherein the housing is adapted for fixed mounting on the face surface of the musical instrument.

4. The optical pickup of claim 1 wherein the light emitter is capable of producing said light beam of a size for impinging the string over a full range of vibrational excursion thereof.

5. The optical pickup of claim 1 wherein the light beam is triangular in cross-section with one leg of the triangular cross-section oriented in parallel with the string.

6. The optical pickup of claim 1 wherein the light beam is directed from the light emitter through a transmission channel within the housing, wherein the transmission channel is of such size, length and orientation as to direct the light beam at the string and the light receiver.

7. The optical pickup of claim 6 wherein the transmission channel is triangular in cross-sectional shape.

8. The optical pickup of claim 6 further comprising a collimating lens positioned at an exit aperture of the transmission channel.

9. The optical pickup of claim 1 wherein the light receiver is mounted within a receiver channel of such size as to shade the light receiver from all light other than the light beam.

10. The optical pickup of claim 9 further comprising an aperture plate mounted at an inlet to said receiver channel, wherein the aperture plate has a triangular aperture therein, the light beam passing through the triangular aperture thereby configured with a triangular cross-section, said triangular cross-section incident on the light receiver.

11. A method for picking up and processing vibrations of a musical instrument, the method comprising the steps of:

mounting a light emitter and light receiver such that a light beam from the light emitter is directed toward and received at the light receiver through a transmission channel with a right angle mirrored transition surface thereby turning the light beam by 90° before exiting the transmission channel;

interposing a vibrating element of the instrument between the light emitter and the light receiver such that the light beam is intercepted by the vibrating element;

producing an output voltage of the light receiver wherein the output voltage is modulated by vibrations of the vibrating element; and driving an audio output device in accordance with the modulated output voltage.

12. An optical pickup for a musical instrument having a vibrating element, optical pickup comprising:

a housing holding a light emitter enabled for producing and directing a light beam through a transmission channel toward the vibrating element wherein the transmission channel has a triangular cross-section capable of emitting the light beam with a triangular cross-section;

a light receiver mounted positioned for receiving the triangular cross-section light beam emitted by the transmission channel, the light beam occluded by the vibrating element of the musical instrument;

an electrical circuit including the light emitter and the light receiver, the electrical circuit enabled for energizing the light emitter for producing the light beam and for converting light energy of the light beam incident on the light receiver to an electrical voltage, the electrical circuit further providing a driver for driving an audio output device.

13. The optical pickup of claim 12 wherein the light emitter is a light emitting diode and the light receiver is a phototransistor.

14. The optical pickup of claim 12 wherein the housing is adapted for fixed mounting on the face surface of the musical instrument.

15. The optical pickup of claim 12 wherein the transmission channel is of a size enabling said light beam to impinge the vibrating element over a full range of vibrational excursion thereof.

16. The optical pickup of claim 12 further comprising a collimating lens positioned at an exit aperture of the transmission channel.

17. The optical pickup of claim 12 wherein the light receiver is mounted within a receiver channel of such size as to shade the light receiver from all light other than the light beam.

18. The optical pickup of claim 12 further comprising an aperture plate mounted at an inlet to said receiver channel, wherein the aperture plate has a triangular aperture therein, the light beam passing through the triangular aperture thereby further configured with a triangular cross-section, said triangular cross-section incident on the light receiver.

* * * * *